US006305105B1

(12) United States Patent
Lowman

(10) Patent No.: US 6,305,105 B1
(45) Date of Patent: Oct. 23, 2001

(54) SNOW REMOVAL APPARATUS

(76) Inventor: Robert T. Lowman, 536 S. Main St., Keyser, WV (US) 26726

( * ) Notice: Subject to any disclaimer, the term of this patent is extended or adjusted under 35 U.S.C. 154(b) by 0 days.

(21) Appl. No.: 09/433,539

(22) Filed: Nov. 3, 1999

(51) Int. Cl.[7] ..... E01H 5/10
(52) U.S. Cl. ..... 37/228; 37/199
(58) Field of Search ..... 37/196, 227, 228, 37/199

(56) References Cited

U.S. PATENT DOCUMENTS 1,160,205 * 11/1915 Smith ..... 37/228
3,066,428 * 12/1962 Raiti ..... 37/228
3,309,798 * 3/1967 Devlin et al. ..... 37/228
3,484,961 * 12/1969 Coslowsky ..... 37/228
3,766,586 * 10/1973 Krickovich ..... 15/83
5,787,613 * 8/1998 Derome ..... 37/228

* cited by examiner

*Primary Examiner*—Robert E. Pezzuto
*Assistant Examiner*—Meredith Petravick

(57) ABSTRACT

An apparatus for disposing of snow that is deposited on a surface. The apparatus includes a removal mechanism that removes the snow from the surface and guides the snow into the apparatus. A first chamber is connected to the removal mechanism. The first chamber has a first aperture that permits fluid to be injected into the snow to aid in melting the snow. A second chamber is connected to the first chamber. The second chamber has an agitating device that moves the snow and separates the snow into a slurry to further melt the snow. A third chamber is connected to the second chamber and is configured to store the melted snow. A disposal mechanism is provided that removes the excess snow from the third chamber. Snow is removed from the surface by the removal mechanism and is melted as it moves through the first chamber, the second chamber, and the third chamber.

17 Claims, 7 Drawing Sheets

SNOW REMOVAL APPARATUS

TECHNICAL FIELD

The present invention relates generally to the removal of snow from streets and sidewalks. More particularly, the present invention relates to an apparatus that removes snow from streets and melts the snow for convenient disposal.

BACKGROUND ART

Locations that expect any appreciable amount of snow during the year must keep roads drivable during the winter. For those locations receiving only a small amount of snow, it is typical to remove snow from roads using a plow or blade attached to a truck or other vehicle. Typically the weather in such locations is warm enough to melt the snow after a few hours or days. However, simply pushing the snow to the side of a road may not be an acceptable solution in locations that receive a great deal of snowfall or that experience sustained sub-freezing temperatures. Snowplows are notorious for plowing thick banks of snow or frozen slush off of a main street such that entrances to side streets and driveways are effectively blocked. Furthermore, narrow streets may have no room along their sides to place the plowed snow. Pushing large amounts of snow into piles is an especial challenge for owners of parking lots and airports, where it may be difficult to push the snow to a place that will not interfere with the normal operation of the parking lot or airport.

One alternative to plowing or pushing snow off of a surface has been to remove the snow to another location. This may be done by loading the snow into dump trucks and having the dump trucks unload the snow at a remote location. This is typically done in parking lots, where large piles of plowed snow may otherwise interfere with the use of the parking lot. This solution requires a high commitment in machinery and manpower, and is therefore an expensive method of snow removal. Another solution has been to spread gravel or other particulate upon the snow surface to provide traction for vehicles driving upon the plowed or unplowed surfaces. However the gravel damages the vehicles when propelled by the spinning tires of the vehicles, and the gravel must be cleaned off of the surface when the snow eventually melts. The gravel also clogs up sewer drainage systems. Still another method is to spread a chemical upon the snow to encourage the early melting of the snow. Known snow-melting chemicals may be hazardous to the health of humans and animals, and some of the chemicals are corrosive to automobiles. Furthermore, most such chemicals work only at temperatures close to the freezing temperature of water. Such chemicals are therefore unreliable in colder climates.

SUMMARY OF THE INVENTION

The present invention provides an apparatus for disposing of snow that is deposited on a surface. The apparatus includes a removal mechanism that removes the snow from the surface and guides the snow into the apparatus. A first chamber is connected to the removal mechanism. The first chamber has a first aperture that permits fluid to be injected into the snow to aid in melting the snow. A second chamber is connected to the first chamber. The second chamber has an agitating device that moves the snow and separates the snow into a slurry to further melt the snow into water. A third chamber is connected to the second chamber and is configured to store the melted snow. A disposal mechanism is provided that removes excess melted snow (water) from the third chamber. Snow is removed from the surface by the removal mechanism and is melted as it moves through the first chamber, the second chamber, and the third chamber.

The present invention also provides an apparatus for disposing of snow that is deposited on a surface. The apparatus includes a removal mechanism that removes the snow from the surface and guides the snow into the apparatus. A first chamber is connected to the removal mechanism. The first chamber has a first aperture that permits fluid to be injected into the snow to aid in melting the snow. A second chamber is connected to the first chamber. The second chamber has a first agitating device that moves the snow and separates the snow into a slurry to further melt the snow. The first agitating device includes a substantially horizontally disposed rotatable shaft and a first plurality of paddles attached to and radially extending from the shaft and configured to rotate about the shaft. Snow is agitated within the second chamber when the shaft rotates. The second chamber further includes a second aperture disposed therein, which is configured to permit fluid to be injected into the second chamber to aid in melting the snow. A third chamber is connected to the second chamber and is configured to store the melted snow. The third chamber encloses a second agitating device that has a vertically-disposed shaft and a plurality of paddles attached to and radially extending from the vertically-disposed shaft. A disposal mechanism is connected to the third chamber and is configured to remove excess water from the third chamber.

DETAILED DESCRIPTION OF THE PREFERRED EMBODIMENT AND BEST MODE OF CARRYING OUT THE INVENTION

Figure 1:
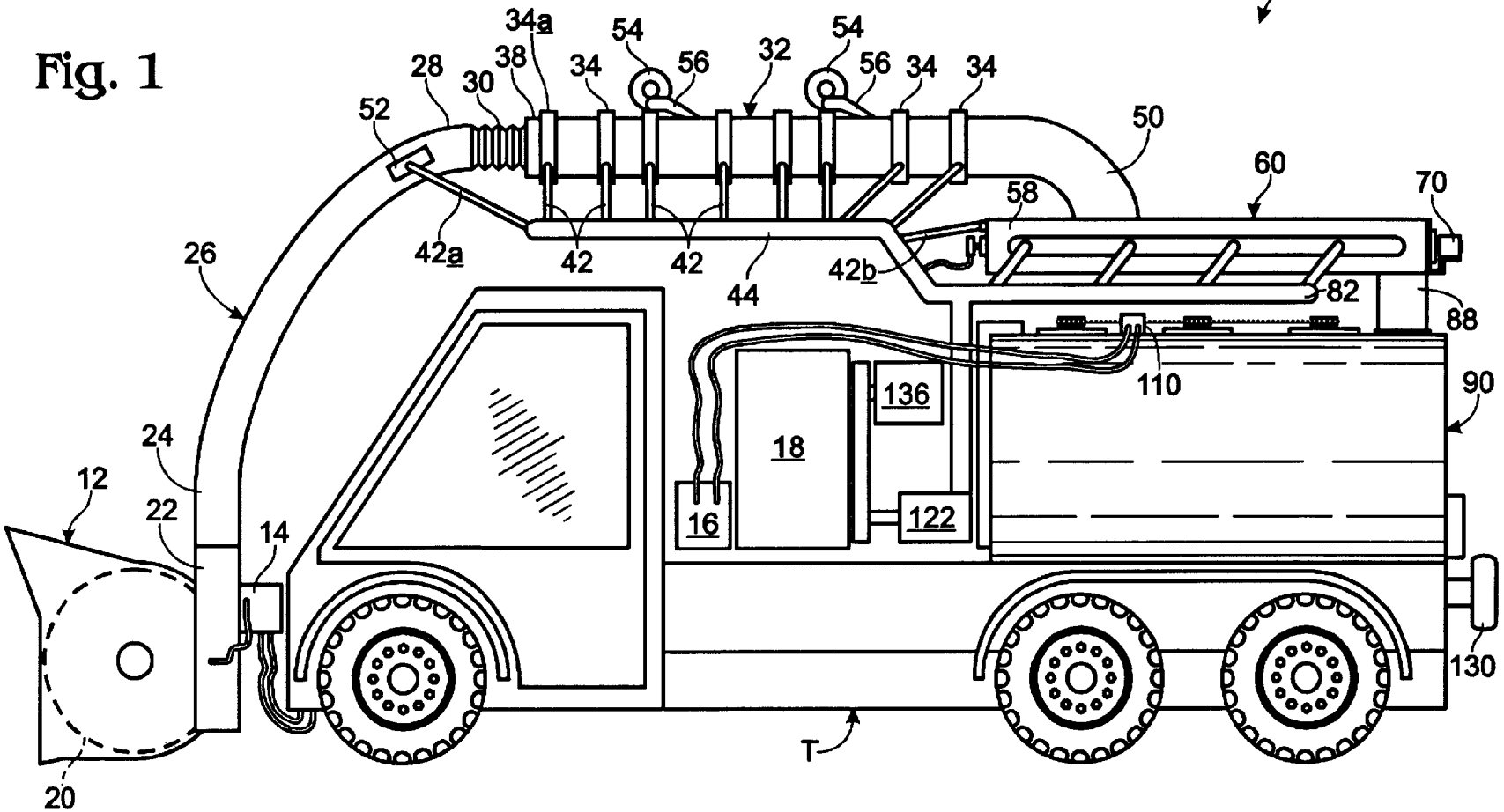
FIG. 1 is a side elevational view of the apparatus according to the invention.

The invention is an apparatus that removes snow from a surface and melts the snow by subjecting the snow to a series of operations as it moves through a series of chambers. FIG. 1 shows the snow removal apparatus 10 of the present invention mounted upon a vehicle. While it is not depicted in the drawings, the apparatus would normally be enclosed by an insulated stainless steel shell. The vehicle is preferably a truck T that is able to accommodate the combined weight of the apparatus and the melted snow created by the apparatus. To accommodate and distribute this combined weight, it may be advisable for the truck to have tandem axles. Four-wheel-drive capability is also preferred to enable the truck to operate on snow-covered roads. However, it is within the scope of the present invention to use other suitable types of trucks. Apparatus 10 is designed to be removable from the truck so that the truck may be used for other purposes. Structure supporting the apparatus on the truck has been removed for the sake of clarity.

The apparatus includes a snow blower 12 mounted in the front of the truck. Snow blower 12 is preferably a known type of blower that is commonly available on the market and is therefore shown in schematic form in FIG. 1. Snow blower 12 is powered by a hydraulic motor 14 that is operatively connected to a hydraulic pump 16. A diesel engine 18 may be used as a power source to motor 14 and pump 16. Diesel engine 18 is used to power other parts of apparatus 10 as will be described hereafter. Alternatively, motor 14 and pump 16 may be powered by a source of power that is separate from engine 18 such that blower 12 may be said to be self-propelled.

Blower 12 includes a system of blades 20, shown in dashed lines in FIG. 1, that direct the snow to a blower outlet 22. Blower outlet 22 urges the snow into the first end 24 of a chute 26, which may have an internal screw mechanism (not shown) to assist in lifting the snow into the remainder of the apparatus. Blower outlet 22 and first end 24 of chute 26 are preferably disposed at the far left or right of the blower blades, as taken from the perspective of a driver of the truck. This off-center arrangement of the blower outlet prevents the outlet from obstructing the driver's view of the street while driving the truck.

The second end 28 of chute 26 is connected to a slip joint or flexible sleeve 30 that connects to a first enclosure or tube, which is shown as a first chamber 32. Flexible sleeve 30 compensates for the vibration of the truck as the truck travels over uneven surfaces.

Figure 2:
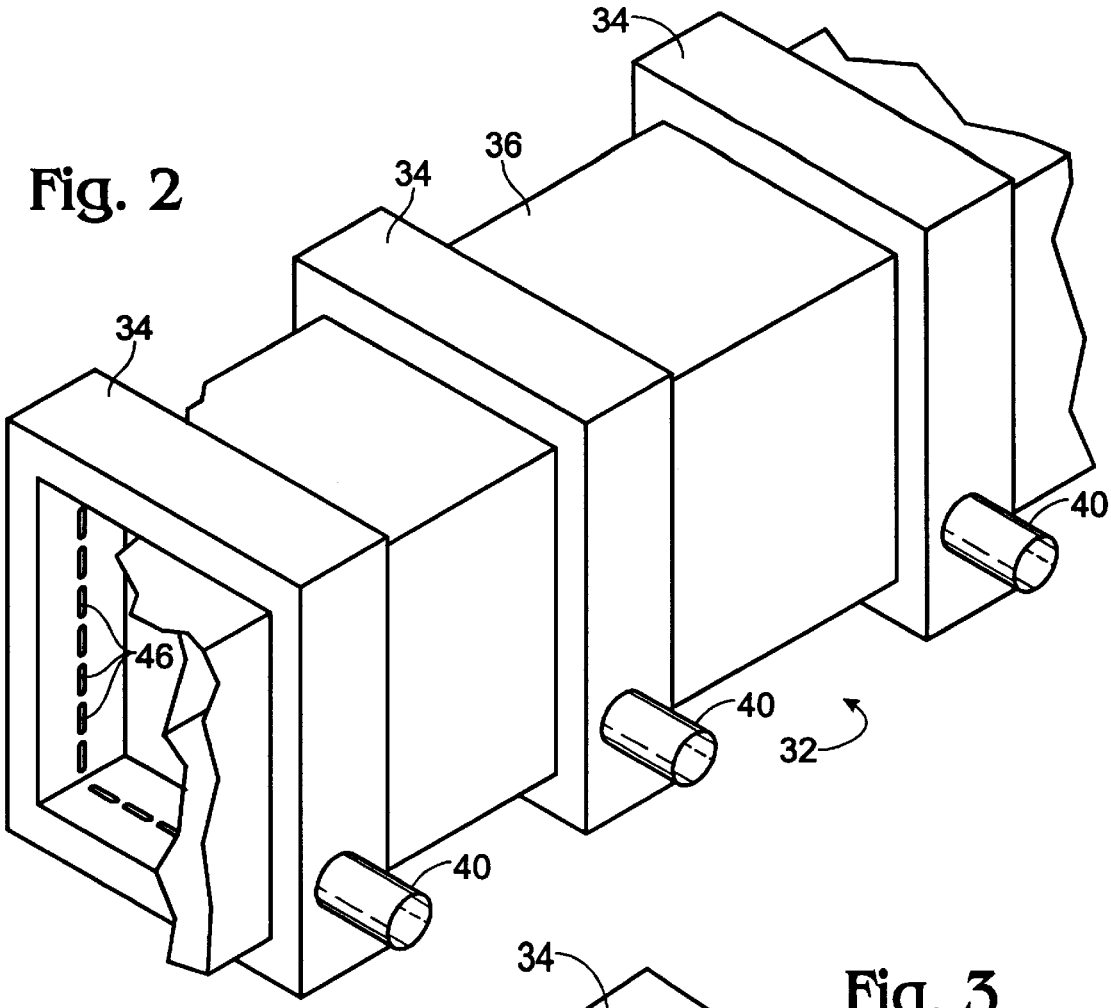
FIG. 2 is a perspective, partially cutaway view of the first enclosure of the apparatus of FIG. 1.
Figure 3:
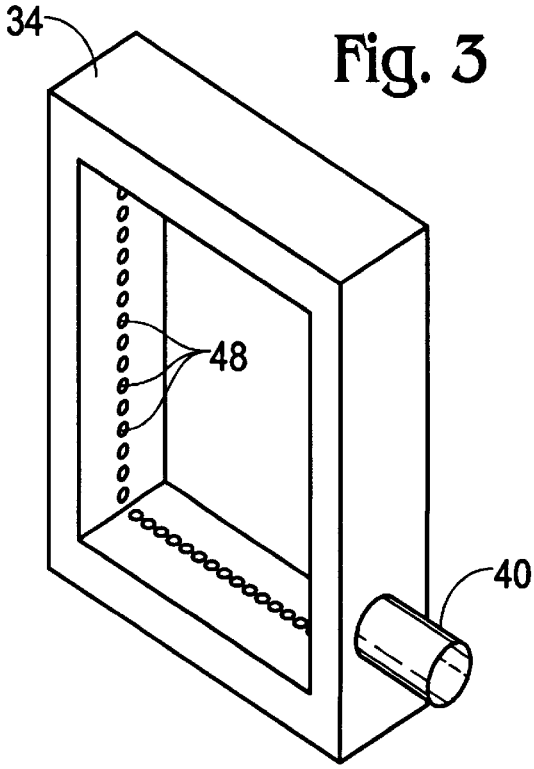
FIG. 3 is a perspective view of an alternative embodiment of a bracket.

Although first chamber 32 may be of any suitable shape or size, it has been found that a 10 to 12 foot long tube having a 14 to 16 inch square cross-section is acceptable. As shown in FIG. 1, a plurality of rings 34 are welded to the outer surface 36 of first chamber 32 so as to encircle the first chamber at varied intervals along the length of the first chamber. One of the rings, designated at 34*a*, is disposed approximately one inch past the first end 38 of first chamber. Each ring 34 is preferably made of thick-walled square tubing. As depicted in FIG. 2, each ring 34 has a hollow fitting 40 that communicates with the hollow interior of the ring. A plurality of flexible tubes or hoses 42 are provided to be mounted upon or otherwise connect to each fitting 40. Flexible hoses 42 are connected to a manifold 44 that distributes pressurized, heated water from a water source (as will be further described), through non-flexible or flexible hoses 42 and into rings 34. A plurality of outlets or apertures are provided in the inner surface of each ring. These apertures communicate with the interior of first chamber 32 such that the pressurized, heated water in rings 34 is directed into the first chamber. The apertures may take the form of slots 46 (FIG. 2), cylindrical holes 48 (FIG. 3), or may have any other shape that effectively directs water into first chamber 32. Slots 46 and holes 48 spray the snow inside first chamber 32 with pressurized, heated water to begin the melting process of the snow. The snow is cut and saturated with water sprayed from slots 46 and urged along the first chamber toward the second end 50 of the first chamber.

As shown in FIG. 1, one or more apertures 52 may also be provided in second end 28 of chute 26. A flexible hose 42*a* extends from manifold 44 to provide a spray of heated, pressurized water to the snow in chute 26 prior to the snow's entering into first chamber 32. This is done to begin the snow melting process in the chute and aids in the movement of snow through the chute.

One or more furnaces or heating elements 54 (FIG. 1) may be provided in connection with first chamber 32. In a preferred embodiment, three to four such furnaces 54 are connected to the first chamber. Air heated by each furnace 54 is directed into a furnace duct 56, which introduces the heated air into the interior of the first chamber. Preferably the heated air is directed into the first chamber at an angle to assist in pushing the snow along the first chamber. The heated air also heats the melted snow and heats the water sprayed from slots 46. In addition to assisting in the melting of the snow, the heated air provided by the furnaces provides an adequate amount of suction inside the apparatus and prevents cold air from being drawn into first chamber 32.

Figure 4:
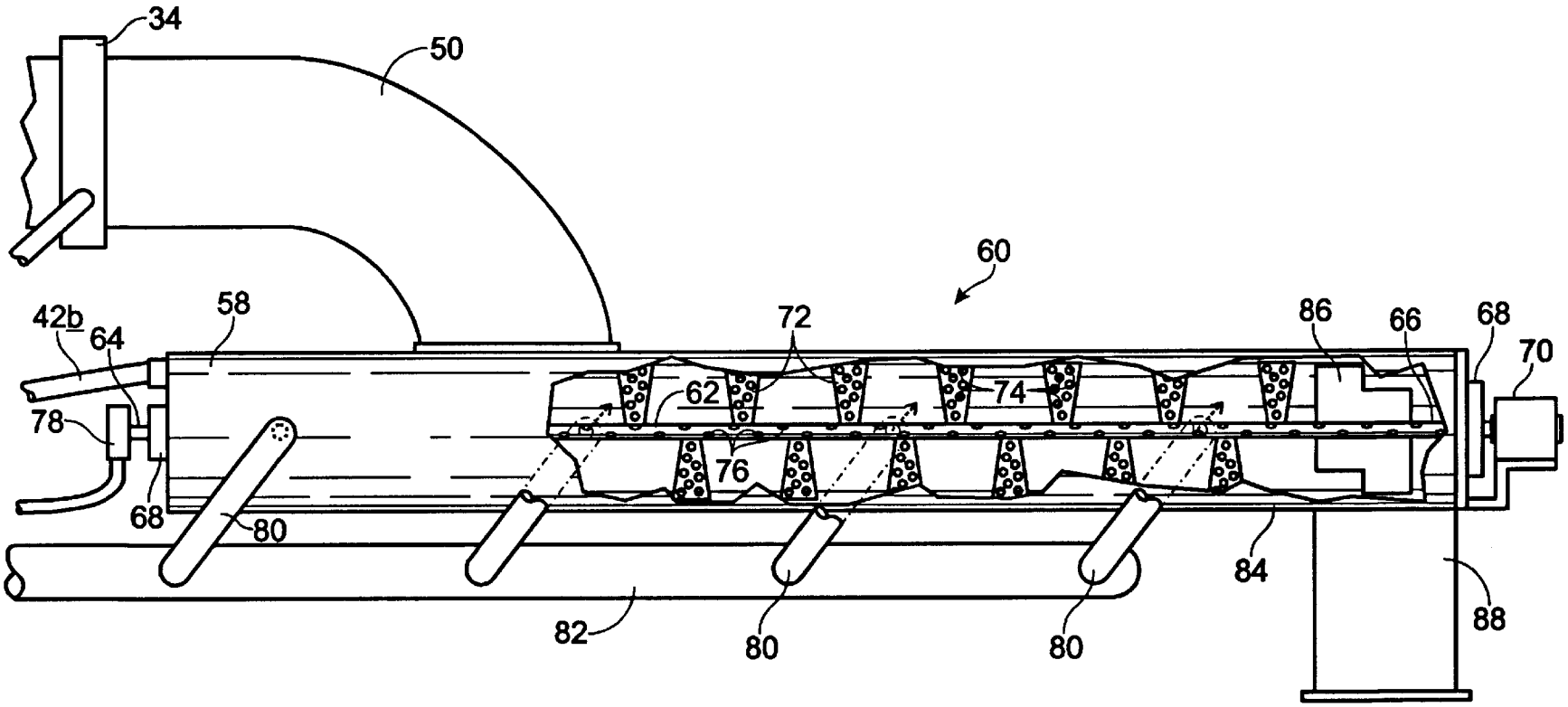
FIG. 4 is a side elevational view of the second enclosure of the apparatus of FIG. 1, with part of the Figure being cut away to show the interior of the second enclosure.

The combination of heated, pressurized water emanating from slots 46 and the heated air from ducts 56 causes a substantial portion of the snow in first chamber 32 to melt or liquefy. The above processes cause the snow to exit first chamber in a semi-melted slurry. As depicted in FIG. 4, second end 50 of first chamber 32 is connected at preferably about a 45 degree angle to the first end 58 of a second enclosure or tube, which is shown as a second chamber 60. The second chamber is preferably cylindrical, with a diameter of at least 24 to 30 inches, and is about 10 to 12 feet long. A shaft 62 is mounted in second chamber 60. Shaft 62 is supported at its first and second ends 64, 66 by bearings 68 such that it is axially rotatable within the second chamber. A hydraulic motor 70 provides rotational force to rotate the shaft as desired, and preferably at a speed of about 400 to 600 rpm. A plurality of beaters or paddles 72 are attached to and radially extend from shaft 62. Paddles 72 agitate and mix the slurry, thereby facilitating the further melting of any remaining snow or slush therein. Paddles 72 are preferably welded or otherwise attached to shaft 62 at an angle to facilitate the movement of the slurry away from first end 58 of the second chamber. Each paddle 72 preferably has one or more holes 74 that may be created by a common drill press. Holes 74 reduce the weight of the paddles and permit water to pass through the paddles and thereby reduce the power necessary to rotate the shaft. It is anticipated that as many as 30 to 40 paddles 72 may be attached to shaft 62. The angled paddles 72 create an amount of suction that draws snow into second chamber 60. Because first chamber 32 is connected to the second chamber, the suction created inside the second chamber is also present in the first chamber.

Shaft 62 may be hollow and have a plurality of apertures 76 therein. A flexible hose, similar to the flexible hoses associated with first chamber 32, connects manifold 44 to the interior of shaft 62 via a connector 78. In this manner, heated and pressurized water may be sprayed on the rotating slurry through apertures 76. Heated and pressurized water is also introduced into second chamber 60 through hose 42*b*, and through outlet tubes 80 that are connected to a secondary manifold 82. Both hose 42*b* and secondary manifold 82 receive water from manifold 44. Outlet tubes 80 are angled to direct water to saturate and push the slurry toward the second end of second chamber 60.

First end 58 of second chamber 60 may be defined by a steel plate (not shown) that seals an open end of a hollow tube or pipe. First end 64 of shaft 62 and connector 78 would then be fastened to the steel plate. Other methods of constructing the second chamber are considered to be within the scope of the present invention.

Figure 5:
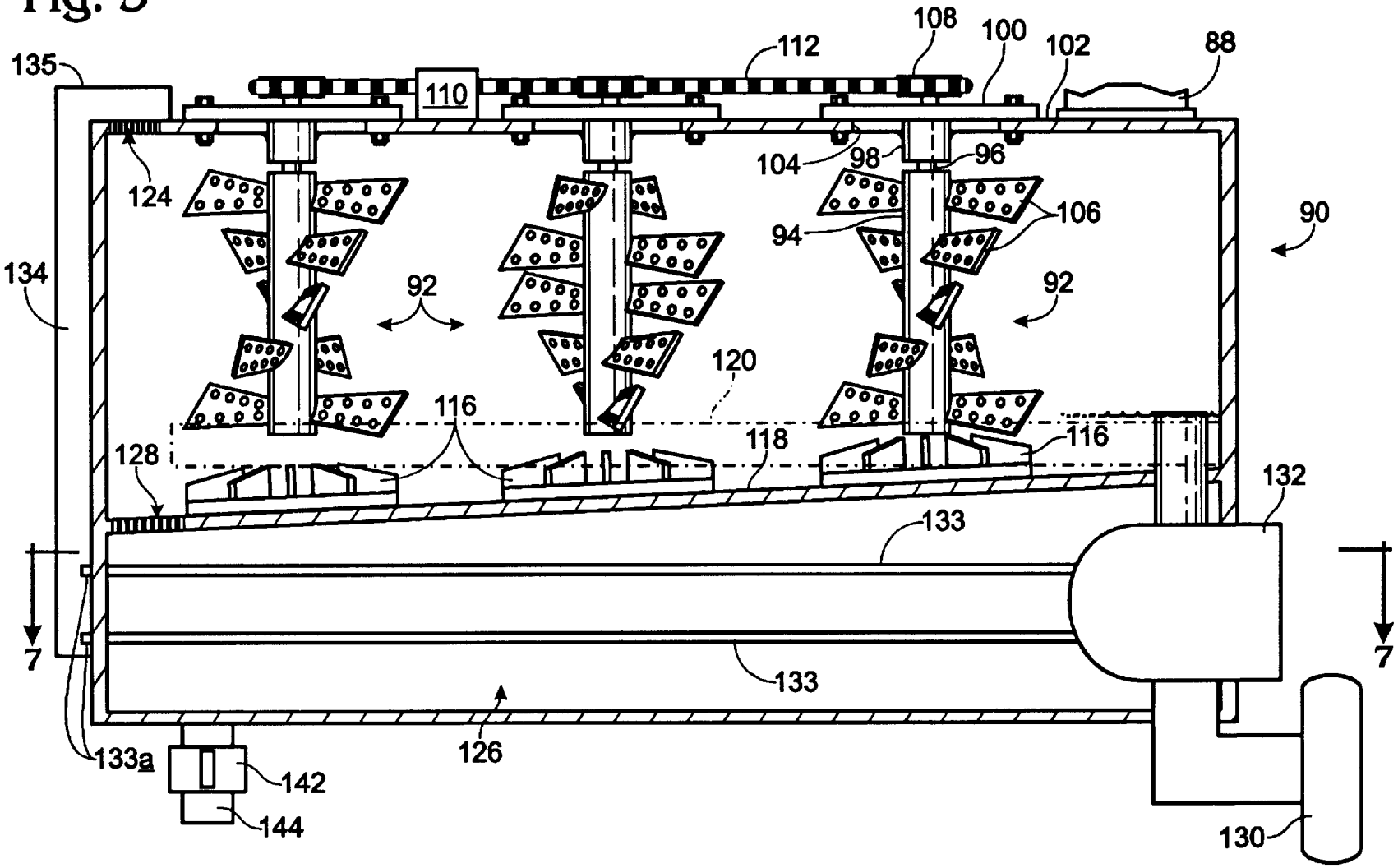
FIG. 5 is a side elevational view of the interior of the third enclosure of the apparatus of FIG. 1.
Figure 6:
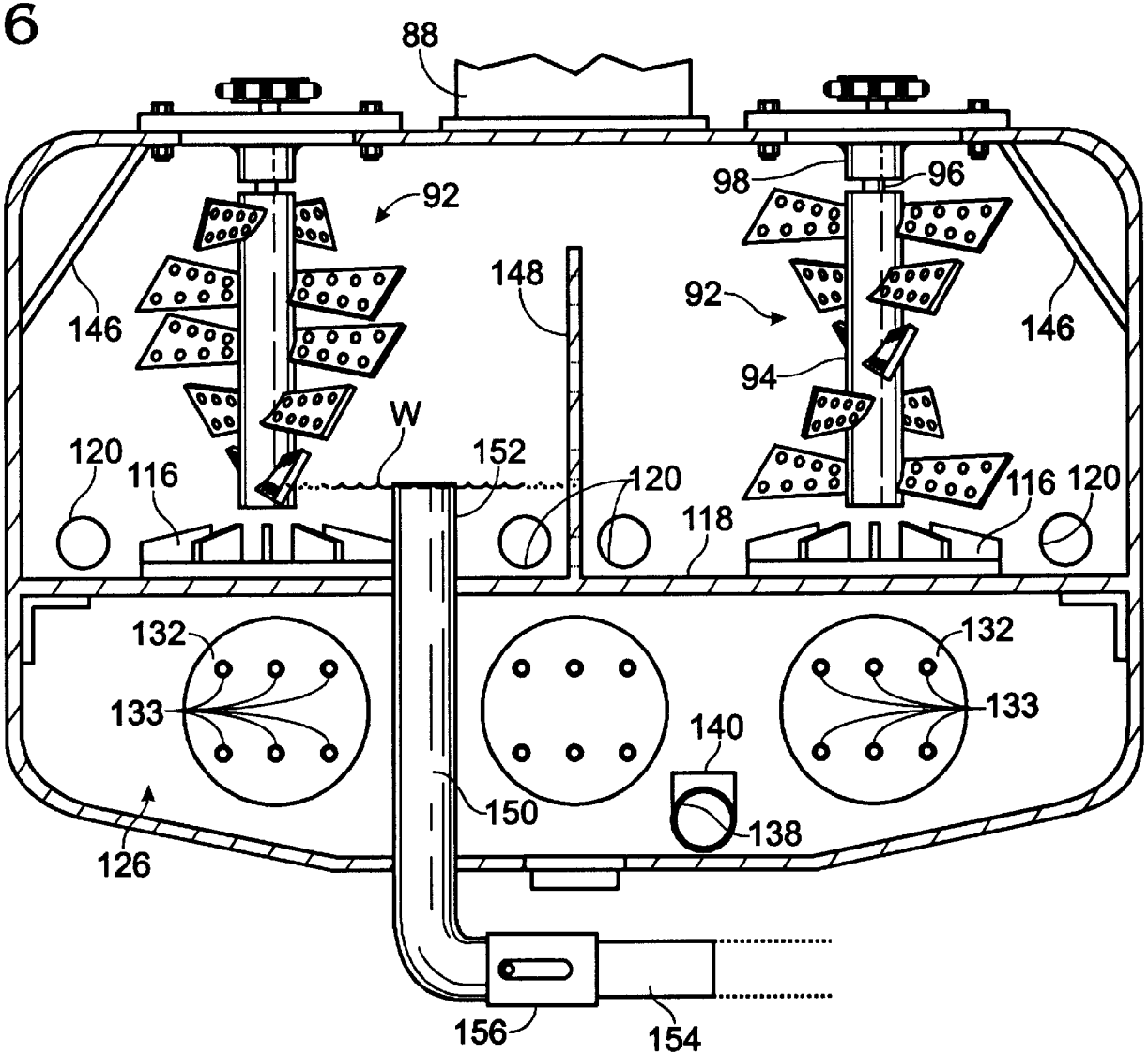
FIG. 6 is an end elevational view of the interior of the third enclosure.

When the slurry has reached the second end 84 of the second chamber, the slurry should be approximately 80 to 90% water. A set of directional paddles 86 are attached to second end 66 of shaft 62 and are configured to guide or force the slurry into a pipe 88, which empties into a third enclosure or chamber. The third enclosure is shown in FIGS. 5 and 6 as a large tank 90. As described below, tank 90 includes features that further mix and heat the slurry, and the tank also serves to store the melted snow until it can be disposed of. Preferably, tank 90 has a capacity of between 1000 and 4000 gallons.

Figure 8:
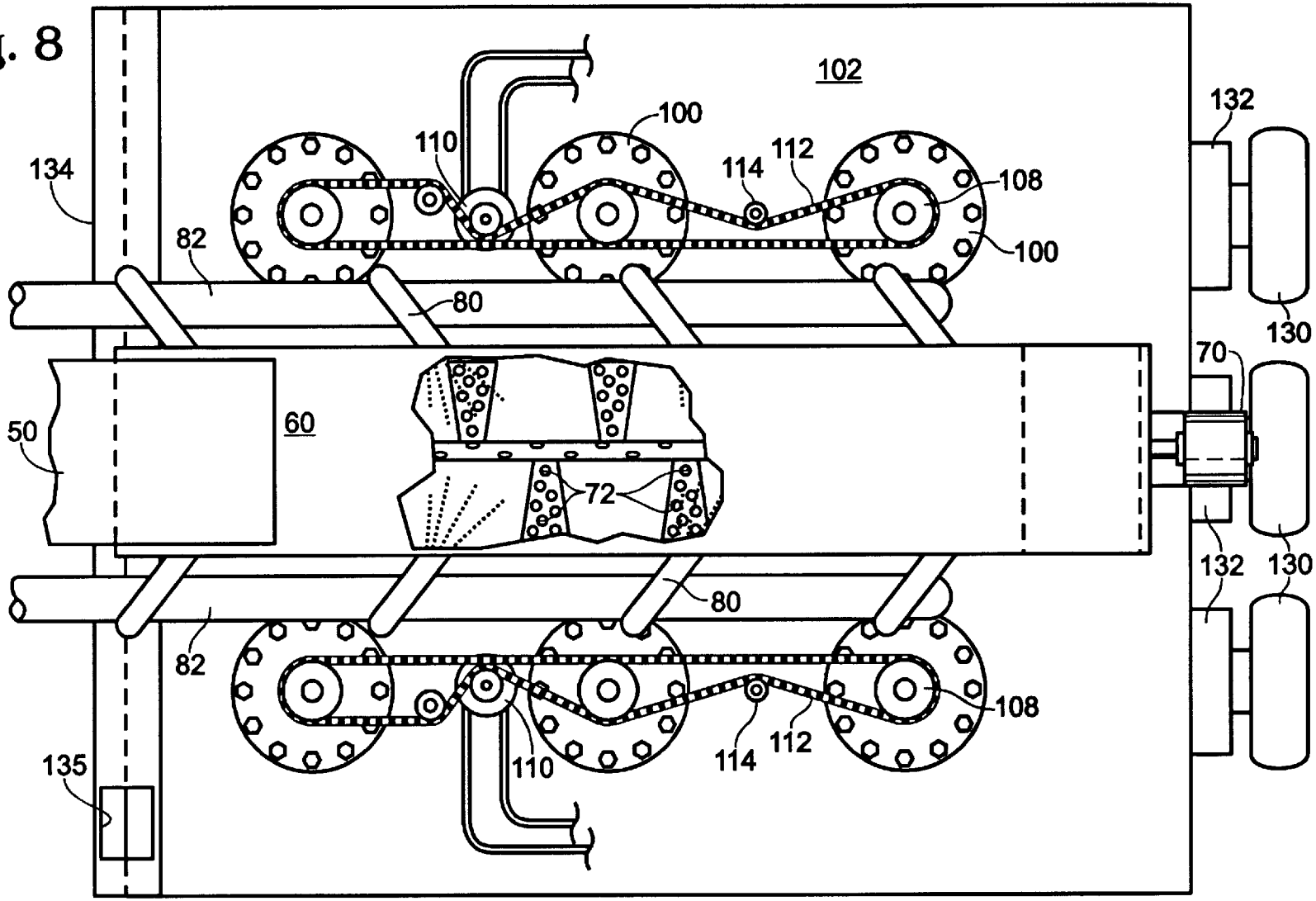
FIG. 8 is a top plan view of the second and third enclosures.

A plurality of agitator units 92 are disposed within tank 90. Each agitator unit comprises a rotatable shaft 94 that has a first end 96 mounted in a bearing assembly 98. Each bearing assembly is mounted on a circular plate 100, which is attached to the upper surface 102 of the tank. Each circular plate covers a hole 104 that has been cut in the upper surface 102 so that the agitator unit may be inserted into the tank. A plurality of angled, perforated paddles 106 are welded or otherwise attached to each shaft 94. A sprocket or gear 108 is attached to first end 96 of each shaft 94 outside of tank 90. As shown in FIG. 8, a hydraulic motor 110 drives a chain 112 that is disposed around the gears 108 of a plurality of agitator units 92 to thereby rotate shafts 94 at a speed of preferably 50 to 150 rpm. Hydraulic motor 110 is powered by hydraulic pump 16. Chain 112 is also directed about at least one adjustable sprocket 114 to maintain proper tension and alignment of the chain. The agitator units will mix the slurry in the tank. As shown in FIGS. 5 and 6, six agitator units 92 are preferably used in the present invention, although more or less may also be employed if desirable or necessary.

The paddles 106 on adjacent agitator units 92 may be alternately arranged so that the melting snow is urged upward by one agitator unit and downward by an adjacent agitator unit. A series of stationary cutter plates 116 are disposed upon an intermediate floor 118 inside the tank. The cutter plates are radially disposed about the rotating axis of each shaft 94. The cutter plates break up snow and ice as it is being agitated by the agitator units. A plurality of spray pipes 120 extend through the bottom of the tank. Each spray pipe 120 is connected to a water pump 122 either directly or through one of manifolds 44, 82. Each spray pipe has a plurality of holes that permit water to be sprayed into the tank. Spray pipes 120 thereby further cause the slurry to melt. Water pump 122 is powered by diesel engine 18, which also powers hydraulic motors 14, 70 and 110 and hydraulic pump 16.

To prevent the water and air inside the tank from becoming too hot, a vent 124 is provided through upper surface 102 of the tank.

Figure 7:
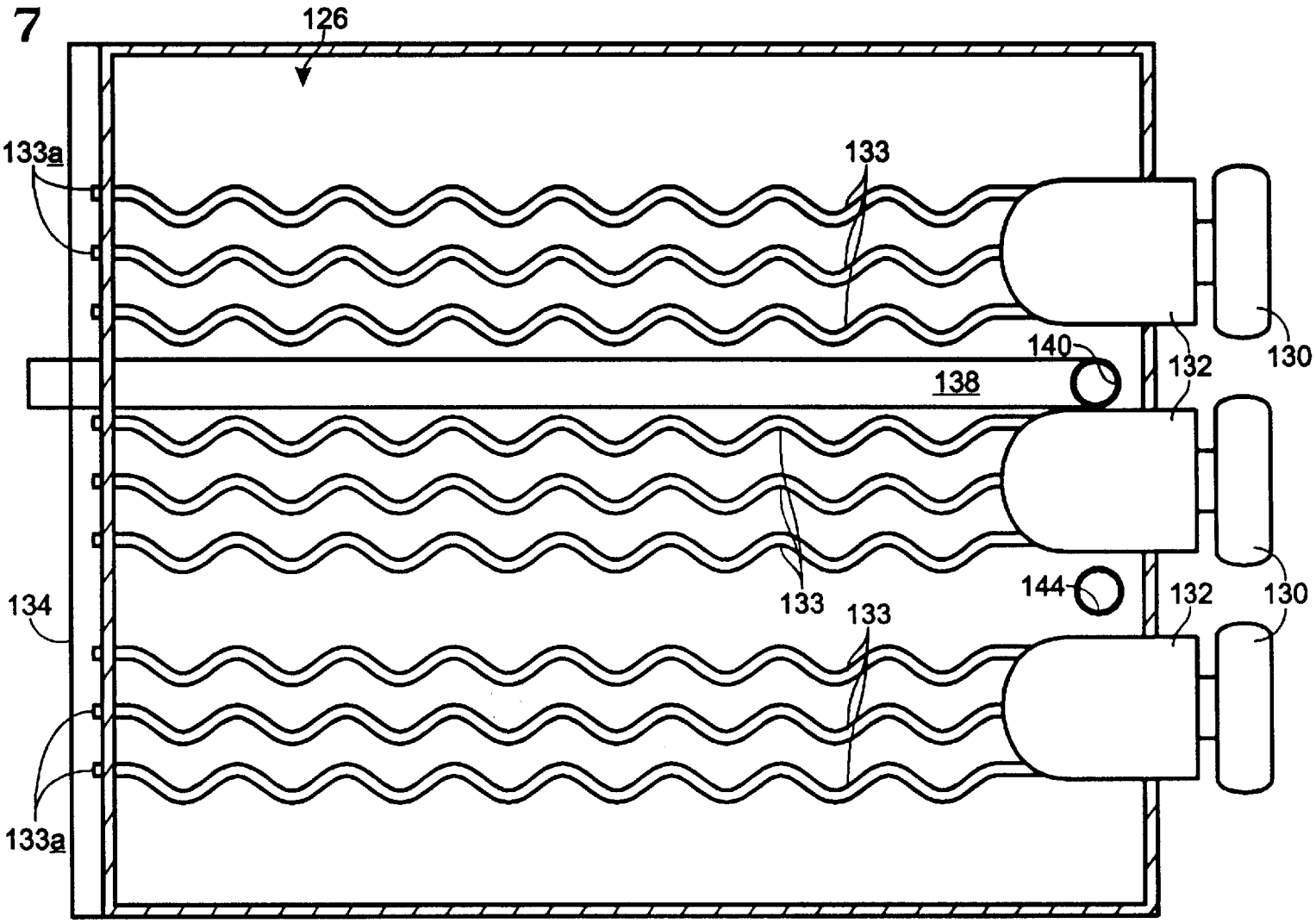
FIG. 7 is a sectional view taken along line 7—7 in FIG. 5.

As shown in FIG. 5, intermediate floor 118 is slanted to allow free movement of water down into a heat chamber 126 that is disposed below the portion of the tank where the agitator units are disposed. A gate or screen 128 is provided in an opening therebetween to prevent stones or other debris from entering the heat chamber. A plurality of furnaces or heaters 130 force heated air into heat bonnets 132 that distribute the heated air into a plurality of heat exchange tubing 133 disposed within the heat chamber (FIG. 7). Water inside heat chamber 126 is heated by the heated air as the air passes through tubing 133. The heat of the water in the heat chamber rises to heat the water in the upper portion of the tank. The heated air exits the distal open ends 133*a* of tubing 133 and is directed into a duct 134. Duct 134 is disposed along the outside of tank 90, as shown in FIG. 5. An opening 135 at the top of duct 134 vents the duct to the atmosphere. Opening 135 also provides an opening to the atmosphere for vent 124. Heaters 130 are preferably powered by a generator 136, which is in turn powered by diesel engine 18.

A tube 138 is disposed along the length of the bottom of heat chamber 126. Tube 138 has an upwardly angled inlet 140 (preferably about 90 degrees) that permits entry of water heated in the heat chamber, yet prevents entry of small stones or other debris. Tube 138 extends out of the tank and is connected to water pump 122. Water pump 122 is in turn connected to manifold 44 and secondary manifold 82 as well as spray pipes 120. In this way, heated and pressurized water is provided to the various spray apertures in apparatus 10. Preferably the water so provided is heated to a temperature of between 80–120 degrees Fahrenheit and a pressure of 50–70 psi. Other temperatures and/or pressures may also be used.

At least one clean-out valve 142 and outlet 144 are provided in the bottom of heat chamber 126. This allows tank 90 and heat chamber 126 to be flushed out without entering the tank.

As previously stated, tank 90 may hold as much as 4000 gallons of water. Braces 146 are therefore provided within tank 90 to strengthen the tank and prevent the tank from bulging and rupturing under such a heavy load of water. At least one baffle 148 is also provided along the midsection of the interior of the tank to prevent the water contained therein from suddenly shifting when the truck makes quick turns. Baffle 148 has a plurality of holes (not shown) to allow some fluid flow between the two sides of the baffle.

An emptying tube 150 is disposed within tank 90 (FIG. 6). A first end 152 of emptying tube 150 is disposed above intermediate floor 118. First end 152 is so positioned to ensure that an amount of water W is always contained within the tank and the heat chamber. Therefore, there will always be a supply of water to be heated and drawn into tube 138 to spray melting snow as the snow moves through apparatus 10, as has been described. The second end 154 of the emptying tube has an emptying valve 156 that may be selectively opened to empty the tank of any water that is above the level of the first end 152.

In operation, a driver drives truck T and manipulates snow blower 12 into an amount of snow. Snow blower blades 20 pick up the snow and place the snow in blower outlet 22. The snow is urged upwardly through chute 26. A spray of pressurized and heated water enters second end 28 of the chute through apertures 52. This spray begins the melting of the snow and assists in directing the snow into first end 38 of first chamber 32. Once inside the first chamber, the snow is heated via furnaces 54 and is also sprayed by water through slots 46 in tubing 34. The snow continues to melt into slurry as it is directed by the heated and pressurized spray to second end 50 of the first chamber. The slurry falls into first end 58 of second chamber 60, where it is further subjected to heated and pressurized water that enters the second chamber through hose 42*b*, holes 74, and outlet tubes 80. Rotating paddles 72 disposed upon shaft 62 pulverize the slurry and mix the heated water into the slurry, thereby further melting the slurry. Directional paddles 86 dump the slurry through pipe 88 and into tank 90. Agitator units 92 rotate to continue the mixing and pulverizing of the slurry, which by the time it enters tank 90 is about 80–90 percent liquefied. Cutter plates 116 also help in breaking up stubborn chunks of ice or snow. Spray pipes 120 also introduce pressurized and heated water into tank to further heat the slurry.

When tank 90 is sufficiently full, the driver drives truck T to a sewer grate, inlet, or other suitable disposal area and opens emptying valve 156. Water above the level of first end 152 of emptying tube 150 is quickly and easily drained out of tank 90. Water below the level of the first end of the emptying tube remains in the tank to be used in the spraying and heating processes described above.

Thus, the apparatus of the present invention quickly disposes of large amounts of snow by liquefying the snow and disposing of the resulting water though normal and natural channels. The apparatus does not require the application of harmful chemicals on the snow. Another advantage is that a single driver and machine can completely remove snow from areas where the snow cannot be pushed to the side or piled up. This compares favorably to the equipment and personnel costs of using a team of dump trucks and front-end loaders. Yet another advantage is that the apparatus may be removed from the truck when not in use, thereby permitting the truck to be used for other purposes. Still another advantage is that different sizes of the apparatus may be made. For instance, an apparatus using 4000–5000 gallons of water could be used in larger cities; an apparatus using 2000–2500 gallons could be used in smaller towns; and a smaller apparatus using 500–700 gallons could be used to remove snow from sidewalks. Other sizes and capacities may also be constructed and are within the scope of the present invention. Still another advantage is that the heated water is heated only to a temperature of 80–120 degrees Fahrenheit. This is hot enough to melt snow, but is not hot enough to cause serious injury to a driver or maintenance worker. Excess amounts of steam are therefore not created by the processes of the apparatus.

While the invention has been disclosed in its preferred form, the specific embodiments thereof as disclosed and illustrated herein are not to be considered in a limiting sense as numerous variations are possible. Applicant regards the subject matter of the invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims are also regarded as included within the subject matter of applicant's invention irrespective of whether they are broader, narrower, or equal in scope to the original claims.

I claim:

1. An apparatus for disposing of snow that is deposited on a surface, comprising:

a removal mechanism that removes the snow from the surface and guides the snow into the apparatus;

a first chamber connected to the removal mechanism, the first chamber having a first aperture that permits fluid to be injected into the snow to aid in melting the snow;

a second chamber connected to the first chamber, the second chamber having a first agitating device that moves the snow and separates the snow into a slurry to further melt the snow;

a third chamber connected to the second chamber and configured to store the melted snow, and further including a second agitating device disposed within the third chamber to further melt the snow; and a disposal mechanism for removing excess snow from the third chamber;

wherein the snow is removed from the surface by the removal mechanism and is melted as it moves through the first chamber, the second chamber, and the third chamber.

2. The apparatus of claim 1, wherein the fluid injected into the first chamber through the first aperture is heated water.

3. The apparatus of claim 1, further including a first heater that directs heated air into the first chamber to aid in melting the snow.

4. The apparatus of claim 1, wherein the removal mechanism further includes a second aperture that permits fluid to be injected into the snow prior to entering the first chamber to aid in melting the snow.

5. The apparatus of claim 1, further including a third aperture disposed inside the second chamber, the third aperture configured to permit fluid to be injected into the second chamber to aid in melting the snow.

6. The apparatus of claim 1, wherein the agitating device comprises a rotatable shaft and a first plurality of paddles attached to and radially extending from the shaft and configured to rotate about the shaft, wherein snow is agitated within the second chamber when the shaft rotates.

7. The apparatus of claim 6, wherein at least one of the first plurality of paddles has holes passing therethrough.

8. The apparatus of claim 6, wherein the shaft is hollow and has an outer wall, and further including a third aperture in the wall of the shaft, the third aperture being configured to permit fluid to be injected into the second chamber to aid in melting the snow.

9. The apparatus of claim 6, wherein the shaft is oriented substantially in a horizontal direction.

10. The apparatus of claim 1, wherein the second agitating device includes a vertically-disposed shaft and a plurality of paddles attached to and radially extending from the vertically-disposed shaft.

11. The apparatus of claim 10, wherein the second agitating device further includes a stationary separating device that is disposed coaxial with the vertically-disposed shaft, wherein the separating device breaks up unmelted segments of snow that are moved about by the paddles on the vertically disposed shaft.

12. The apparatus of claim 1, wherein the third chamber includes a holding tank into which the second chamber empties, and wherein the third chamber further includes a heating chamber disposed below the holding tank and connected to the tank, the heating chamber configured to heat the water in the holding tank.

13. The apparatus of claim 12, further including a plurality of heating units that heat the water within the heating chamber.

14. The apparatus of claim 12, further including a first pipe that passes through the heating chamber, wherein water within the first pipe is heated in the heating chamber, and wherein the first pipe is connected to the first aperture.

15. The apparatus of claim 1, wherein the disposal mechanism is connected to the third chamber, and wherein the disposal mechanism is configured to leave an amount of water in the third chamber.

16. An apparatus for disposing of snow that is deposited on a surface, comprising:

a removal mechanism that removes the snow from the surface and guides the snow into the apparatus;

a first chamber connected to the removal mechanism, the first chamber having a first aperture that permits fluid to be injected into the snow to aid in melting the snow;

a second chamber connected to the first chamber, the second chamber having a first agitating device that moves the snow and separates the snow into a slurry to further melt the snow, wherein the first agitating device includes a substantially horizontally disposed rotatable shaft and a first plurality of paddles attached to and radially extending from the shaft and configured to rotate about the shaft, wherein snow is agitated within the second chamber when the shaft rotates, the second chamber further including a second aperture disposed therein, the second aperture configured to permit fluid to be injected into the second chamber to aid in melting the snow;

a third chamber connected to the second chamber and configured to store the melted snow, the third chamber enclosing a second agitating device having a vertically-disposed shaft and a plurality of paddles attached to and radially extending from the vertically-disposed shaft; and a disposal mechanism, connected to the third chamber, for removing excess water from the third chamber.

17. The apparatus of claim 16, further including a manifold that distributes heated fluid from a heated fluid source to the first and second apertures.

* * * * *